United States Patent [19]

Fukuda et al.

[11] Patent Number: 4,581,796

[45] Date of Patent: Apr. 15, 1986

[54] APPARATUS FOR AUTOMATICALLY PRODUCING CABLE WITH CRIMPED TERMINALS

[75] Inventors: Michio Fukuda; Toshifumi Okunishi, both of Osaka; Sinkichi Miwa; Yosinobu Ohta, both of Yokkaichi, all of Japan

[73] Assignees: Sumitomo Electric Industries, Ltd.; Tokai Electric Wire Company, Limited, both of Japan

[21] Appl. No.: 638,373

[22] Filed: Aug. 7, 1984

[30] Foreign Application Priority Data

Aug. 12, 1983 [JP] Japan ..... 58-148387

[51] Int. Cl.[4] ..... H01R 43/00

[52] U.S. Cl. ..... 29/33 M; 29/564.4; 29/748; 29/861; 29/867; 81/9.51

[58] Field of Search ..... 29/564.6, 564.4, 564.7, 29/564.8, 566.1, 566.2, 748, 753, 755, 857, 867, 861, 33 M; 81/9.51

[56] References Cited

U.S. PATENT DOCUMENTS

| | | | |
|---|---|---|---|
| 3,155,136 | 11/1964 | Laskowski | 29/564.4 X |
| 3,267,556 | 8/1966 | Scharf | 29/564.4 |
| 3,769,681 | 11/1973 | Eubanks | 29/564.4 |
| 3,800,389 | 4/1974 | Brehm et al. | 29/564.4 |
| 3,872,584 | 3/1975 | Click et al. | 29/33 M X |
| 3,909,900 | 10/1975 | Gudmestad | 29/564.4 |
| 4,164,808 | 8/1979 | Gudmestad et al. | 29/564.6 X |
| 4,194,281 | 3/1980 | Gudmestad | 29/564.4 |
| 4,290,179 | 9/1981 | Bakermans et al. | 29/33 M |
| 4,347,651 | 9/1982 | Inoue et al. | 29/33 M |
| 4,348,805 | 9/1982 | Gibbons | 29/857 |

FOREIGN PATENT DOCUMENTS

| | | | |
|---|---|---|---|
| 50422 | 4/1982 | European Pat. Off. | 29/564.6 |
| 137631 | 4/1985 | European Pat. Off. | 29/753 |
| 921777 | 3/1963 | United Kingdom | 29/857 |
| 2077518 | 12/1981 | United Kingdom | 29/867 |

*Primary Examiner*—William R. Briggs

*Attorney, Agent, or Firm*—Ernest A. Beutler

[57] ABSTRACT

An improved apparatus for automatically producing cable with terminals crimped thereto is disclosed which includes a cable storing section, for storing various kinds of cables, a cable selecting section for selecting a required cable, a cable measuring and cutting section, a cable sheath stripping section for removing insulative sheath at the foremost end parts of the cable, a terminal crimping section having a plurality of terminal pressure connecting machines arranged in line along a conveyor, and a control circuit. The control circuit automatically controls selection of kinds of cables and terminals and their working conditions at every time when operations are achieved in each of the sections. The cable measuring and cutting section is provided with a direct measuring mechanism in which a distance of movement of the measuring head is measured while it is stretched under the effect of tension. The cable sheath stripping section is preferably provided with a stripping length adjusting mechanism which serves to adjustably determine the length of naked wire portion of the cable at the foremost end parts thereof with insulative sheath removed therefrom.

12 Claims, 8 Drawing Figures

APPARATUS FOR AUTOMATICALLY PRODUCING CABLE WITH CRIMPED TERMINALS

BACKGROUND OF THE INVENTION

1. Field of the Invention

The present invention relates to an apparatus for automatically producing cable with crimped terminals and more particularly to an apparatus for automatically and continuously producing cable with terminals crimped to the foremost ends of cables cut in a predetermined length.

2. Description of the Prior Art

The apparatus of the above-mentioned type is already disclosed, for instance, in Japanese Patent Laid-Open No. 168,378/81. However, it has been found as a problem with the conventional apparatus that any terminals can be crimped to cable having a constant diameter but in case of a combination of cables having various diameter and terminals of various kind, the crimp height (height of terminal after completion of crimping) changes variously to make automatic crimping impossible. Therefore, the conventional apparatus cannot meet various working conditions satisfactorily which are imposed on production of various kinds of cables with crimped terminals.

SUMMARY OF THE INVENTION

Thus, the present invention has been made with the foregoing problem in mind and its object resides in providing an improved apparatus of the early-mentioned type which can meet various working conditions under which various kinds of cables with terminals crimped thereto are produced in small quantity, for instance, in the production system where a single specification is allocated to a single kind of product.

To accomplish the above object there is proposed according to the present invention an apparatus for automatically producing cable with terminals crimped thereto essentially comprising a cable storing section in which various kinds of cables are stored at the position predetermined in accordance with their kind, a cable selecting section for selectively taking a certain cable from the group of cables stored in the cable storing section, a cable measuring and cutting section in which the extended length of a cable selected in the cable selecting section is measured and it is then cut to the measured length, a cable sheath stripping section in which insulative sheaths at the foremost end parts of the cable are stripped, a terminal crimping section including a plurality of terminal crimping machines with a crimp height adjusting mechanism incorporated therein respectively, and a control circuit which assures that kinds of cables and terminals and their working conditions in the above-mentioned sections are automatically and selectively controlled at every time when operations are performed in each of the sections.

In a preferred embodiment of the invention the cable measuring and cutting section is provided with a direct measuring mechanism in which a distance of movement of the measuring head is measured while it is kept in the stretched state.

The cable sheath scraping section is provided with a stripping length adjusting mechanism which serves to adjustably determine the length of naked wire portion of the cable at the foremost end parts thereof with insulative sheath material removed therefrom.

Other objects, features and advantages of the invention will become more clearly from reading of the following specification which has been prepared in conjunction with the accompanying drawings.

BRIEF DESCRIPTION OF THE DRAWINGS

The accompanying drawings will be briefly described below.

DESCRIPTION OF THE PREFERRED EMBODIMENT

Now, the present invention will be described in a greater detail hereunder with reference to the accompanying drawings which schematically illustrate an apparatus in accordance with a preferred embodiment of the invention.

Figure 1:
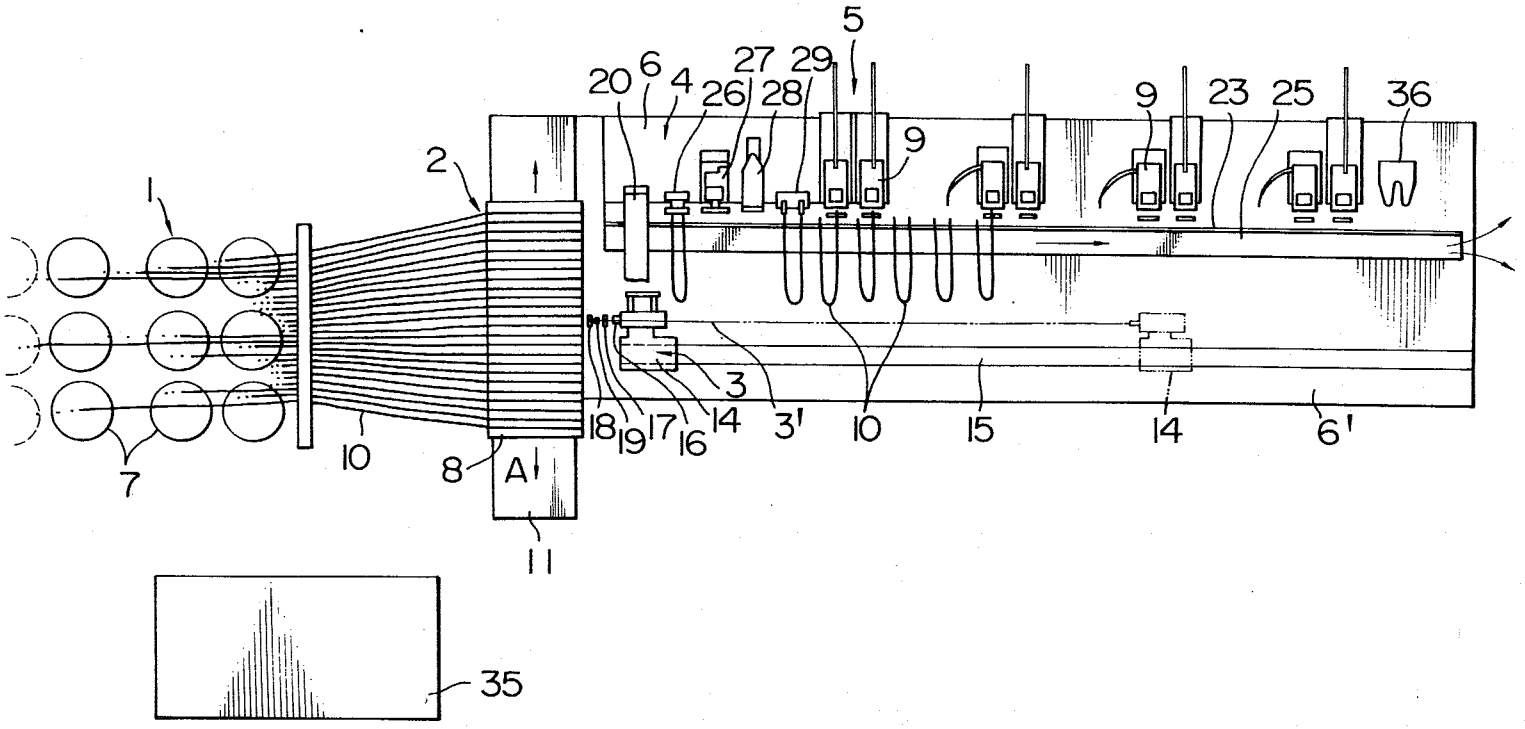
FIG. 1 is a plan view of an apparatus in accordance with an embodiment of the invention.

FIG. 1 is a plan view of the apparatus illustrating how a group of sections constituting the apparatus are arranged. The apparatus includes a cable storing section 1 in which a number of cable storing packs 7 are arranged in tiers, a cable selecting section 2 for holding cables taken from the cable storing section 1 on a movable table 8 so as to allow one required cable to be selected from them, a cable measuring and cutting section 3 in which the cable selectively taken from the movable table 8 is measured with respect to its length and it is then cut to the predetermined length, an insulative sheath stripping section 4 in which insulative sheaths at both ends of the cut cable are stripped therefrom and a terminal crimping section 5 in which a group of terminal crimping machines 9 with a crimp height adjusting mechanism incorporated therein respectively are arranged in the spaced relation and the sections as mentioned above are located at the illustrated positions. It should be noted that these sections exclusive the cable storing section 1 and the cable selecting section 2 are mounted on frames 6 and 6'.

Next, description will be made below as to structure and function of each of the sections.

Figure 2:
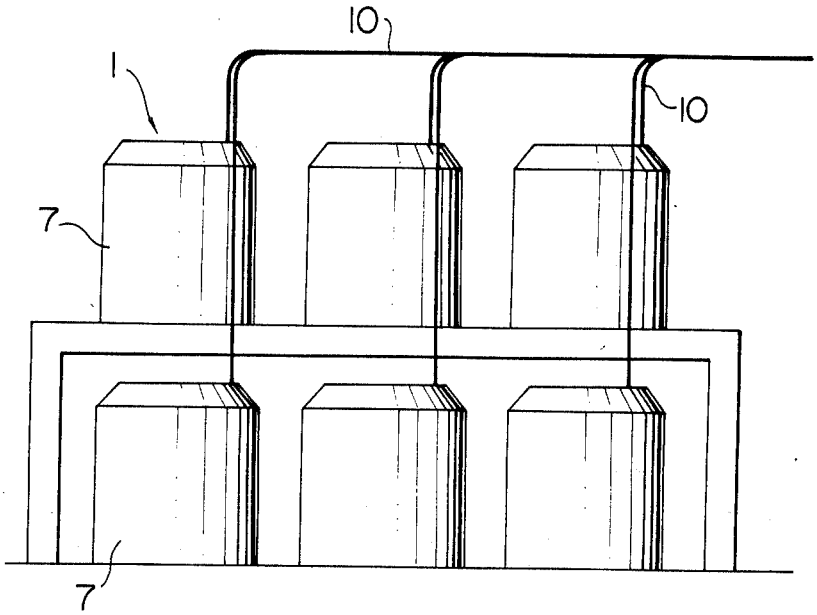
FIG. 2 is a fragmental front view of a cable storing section.

As is apparent from FIG. 2, the cable storing section 1 is constructed such that a plurality of cable bundles in the form of a coil are stored in each of cylindrical hollow packs 7 with their top ends opened to the outside in such a manner that the one end of a cable coil is adjacent to the other end of the next cable coil. Specifically, in the illustrated embodiment thirty six packs 7 ($3\times6$ rows$\times2$ tiers$=36$ packs) are arranged in tiers in the cable storing section 1 so that different kinds of cables are drawn from the packs 7 through their open top ends.

Figure 3:
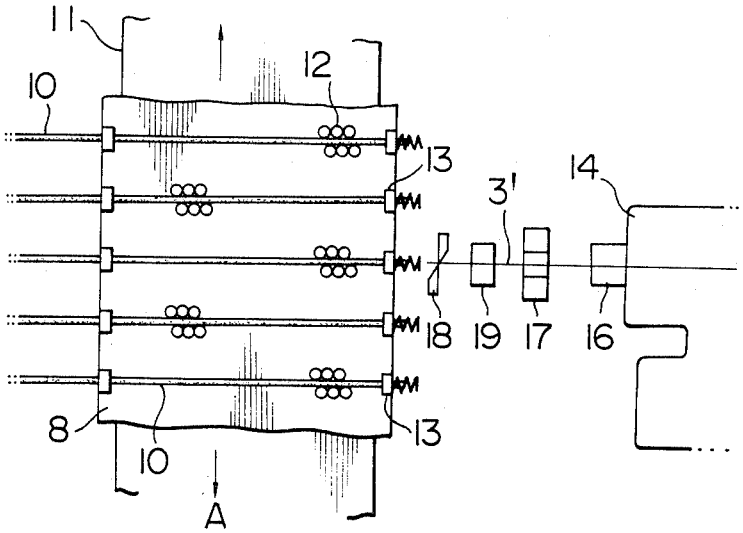
FIG. 3 is a fragmental schematic plan view of a cable selecting section.

As illustrated in FIG. 3, the cable selecting section 2 includes a movable table 8 adapted to reciprocably move on the bed 11 in the directions as identified by arrow marks A in the drawing. The movable table 8 carries thereon different kinds of cables 10 drawn from the packs in the equally spaced relation while it holds them with their foremost ends protruded outwardly of discharge ports 13 by a predetermined distance. Each of the cables 10 is extended on the movable table 8 through a plurality of straightening rollers 12. At every time when the movable table 8 moves, a certain cable 10 to be delivered is correctly selected or indexed to the position where the corresponding discharge port 13 on the movable table 8 is located in exact alignment with a cable receiving part 3' of the cable measuring and cutting section 3.

The cable measuring and cutting section 3 includes a measuring head 14 adapted to linearly move on the rail 15 to measure length of a cable at a high accuracy. The measuring head 14 is provided with an A end clamp 16 at the foremost end thereof. Further, the cable measuring and cutting section 3 includes a joint detector 19 for detecting the jointed part on a cable, cutting knives 18 and a B end clamp 17 each of which is located between the movable table 8 and the A end clamp 16. The measuring head 14 is caused to move, for instance, by operating a timing belt with the aid of a direct current motor. In response to a command issued from a control circuit which will be described later, the measuring head 14 moves toward the cable selecting section 2 while thrusting the joint detector 19, firmly catches the foremost end of a cable 10 on the mcvable table 18 by means of the A end clamp 16, then draws the cable 10 through the joint detector 19 while moving on the rail 15 and finally stops its movement at the command position as identified by dotted lines in the drawing (to measure length of the cable 10 while it is kept in the extended state). Immediately after stoppage of the measuring head 14 the B end clamp 17 firmly catches the other end of the cable 10 and the latter is then cut by operating the cutting knives 18. Thereafter, both the A and B end clamps 16 and 17 transports the cable 10 to the cable receiving position on the cable transferring section which will be described later.

Figure 4:
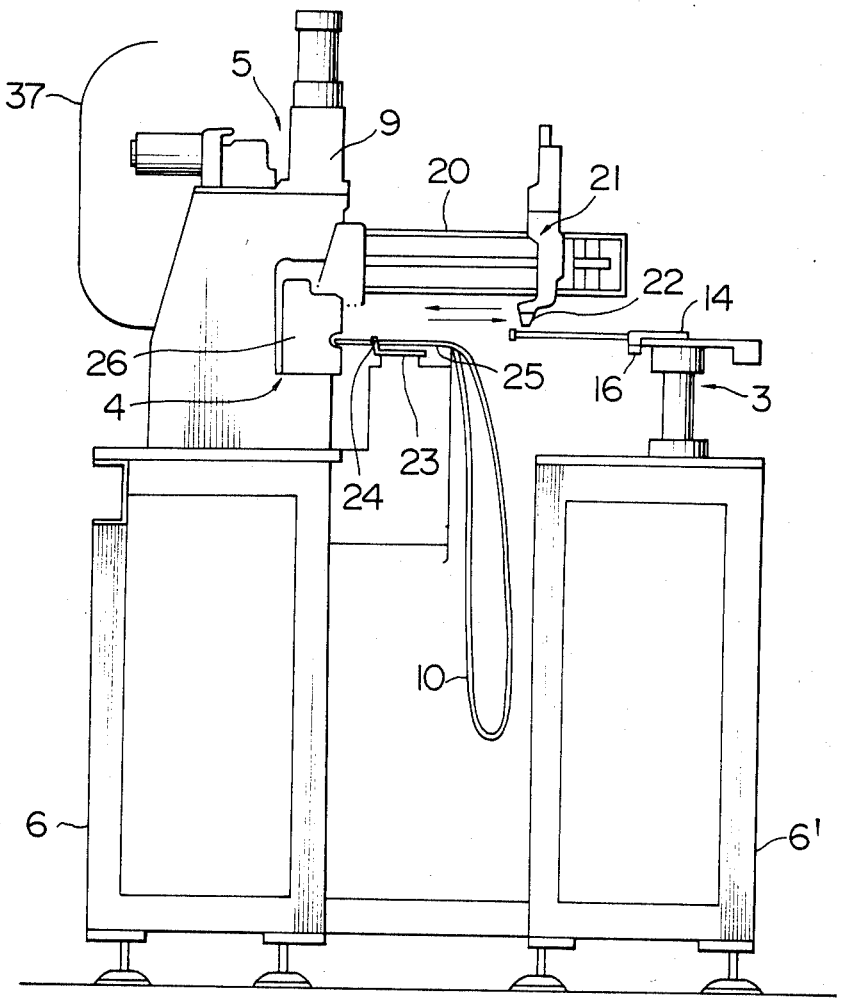
FIG. 4 is a side view of the apparatus particularly illustrating how a cable to be worked is transferred from a cable measuring and cutting section to a cable sheath stripping section.

As illustrated in FIG. 4, a transferring rail 20 with a transferring table 21 mounted thereon is provided between the cable measuring and cutting section 3 and the sheath stripping section 4, and a pair of clamps 22 are provided to the lower end of the transferring table 21. The cable 10 of which both ends are firmly held by means of the A and B end clamps 16 and 17 is transferred to the clamps 22 and it is then further transferred onto a conveyor 23 which extends in the transverse direction in front of the stripping section 4 and the terminal crimping section 5 while it is turned by 90 degrees in the U-shaped configuration. Thus, both the end parts of the cable 10 to be stripped are protruded forwardly of chuck pawls 24 disposed on the conveyor 23 while they are immovably held by means of the chuck pawls 24. Since the conveyor 23 is driven, for instance, by operating a timing belt with the aid of a direct current motor, the U-shaped cable 10 (hereinafter referred to as work 10) is displaced stepwise in the transverse direction in front of the stripping section 4 and the terminal crimping 5 with an exact pitch being maintained. In the drawing reference numeral 25 designates a table which facilitates stepwise displacement of the work 10.

Figure 6A:
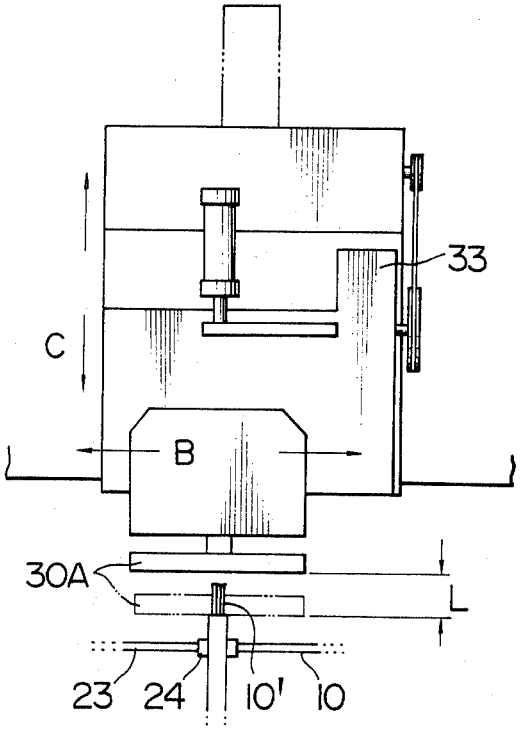
FIG. 6(A) is a schematic plan view of a cable sheath stripping machine.
Figure 6B:
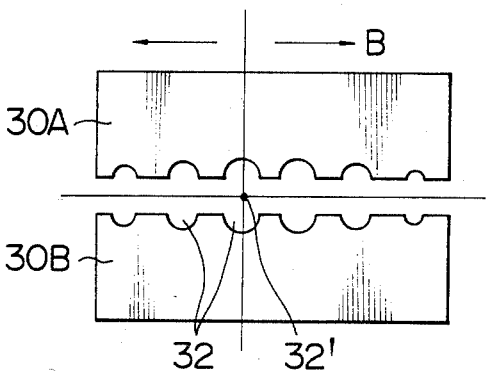
FIG. 6(B) is a front view of sheath stripping knives.

Specifically, the stripping section 4 includes a foremost end cutting machine 26, a sheath stripping machine 27, a naked wire twisting machine 28 and an electrical communication confirming machine 29 which are arranged in series. The foremost end cutting machine 26 serves to cut both end parts of the work 10 (hereinafter referred to as A end and B end) by an appreciably short length in order to assure that both the foremost ends of the work 10 firmly held by means of the chuck pawls 24 on the conveyor 23 are exactly located in line so as to allow the subsequent steps to be executed at an improved working efficiency. As illustrated in FIG. 6, the sheath stripping machine 27 includes an opposing pair of sheath stripping knives 30A and 30B with a plurality of sheath cutting grooves 32 (six grooves in the illustrated case) formed thereon corresponding to diameters of cables to be worked, a slide adapted to move in both directions as identified by arrow marks B in the drawing (the direction of displacement of the work 10) with the sheath stripping knives 30A and 30B mounted in front of the slide and a slide member 33 adapted to move forward and backward in both the directions as identified by arrow marks C in the drawing. The slide member 33 correctly carries out displacement as mentioned above by operating an actuating mechanism such as hydraulic cylinder, cam or the like, causes the sheath cutting knives 30A and 30B to stop in front of the work 10 which has been immovably held at the working position 32' while one sheath cutting groove 32 specially selected from plural ones on the sheath stripping knives 30A and 30B, then moves forward by a required length of stroke L equal to the length of sheath to be stripped from the work 10, carries out sheath stripping by allowing both the sheath scraping knives 30A and 30B to come in contact with one another and finally moves backward to the initial position. Thus, a naked wire portion 10' having the required length is formed on the foremost end part of the work 10 by way of the above-described steps.

The naked wire twisting machine 28 is intended to twist the naked wire portion 10' so as to inhibit wires in the naked wire portion 10' from being loosened. Finally, the electrical communication confirming machine 29 is used to confirm whether sheath stripping is achieved correctly or not, while electrical communication pieces are bridged between both the naked end parts 10' of the work 10 on the conveyor 23.

Figure 5:
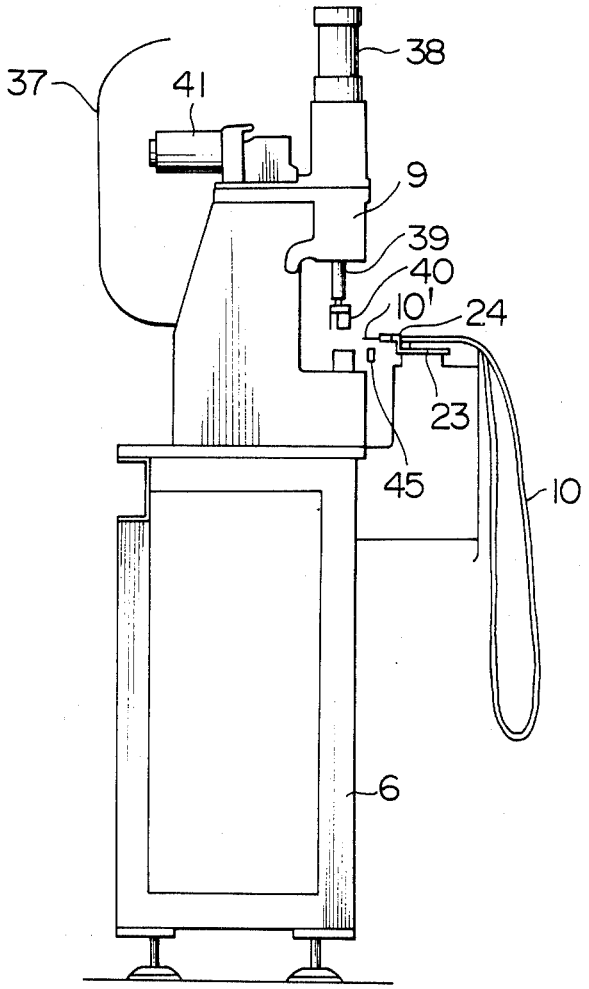
FIG. 5 is a side view of a terminal crimping section.
Figure 7:
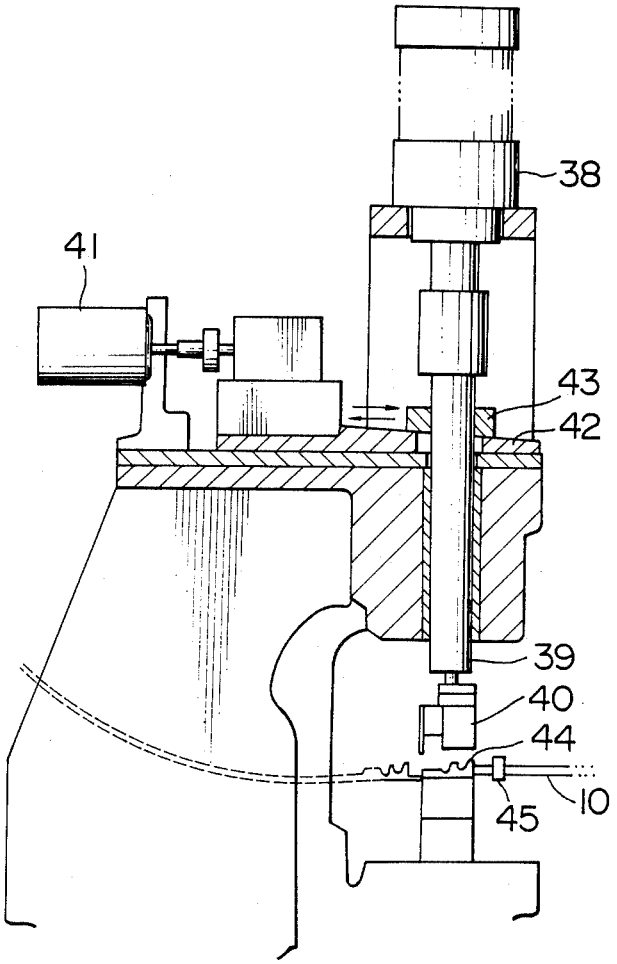
FIG. 7 is a side view of a terminal pressure connecting machine.

The final terminal connecting section 5 is constituted by a combination of a plurality of crimping machines 9 (eight pressure connecting machines in the illustrated embodiment) and a crimping confirming device 36 disposed at the rearmost end part of the terminal crimping section 5, the pressure connecting machines 9 being arranged in line and each of them holding a number of terminals of different kind to be connected to the work 10. As illustrated in FIGS. 5 and 7, the pressure connecting machine 9 includes a terminal feeder 37 for feeding a chain of terminals arranged in the form of a band, a press ram 39, a conventional crimping mechanism with a pressure connecting tool 40 fitted to the bottom of the press ram 39, and a crimp height adjusting mechanism for adjusting a crimp height of terminals to be crimped as required. As will be best seen in FIG. 7, the crimp height adjusting mechanism is typically constructed by a lower dead end stopper 43 displaced up and down by operating the press ram 39 and a movable tapered spacer 42 located on the head of the crimping machine 9, the tapered spacer 42 moving forward and backward in the directions as identified by arrow marks in the drawing by rotating a motor 41. Thus, the lower dead end position of the press ram 39 can be determined as required by forward or backward movement of the tapered spacer 42 whereby the crimp height of a terminal 44 is easily adjusted. Further, the crimping machine 9 is provided with a holding pawl 45 at the position located forwardly therefrom which serves to receive the work 10 from the chuck pawl 24 on the conveyor 23. The holding pawl 45 is operatively associated with the press ram 39 to move up and down as the latter is actuated whereby the work 10 is placed on the press anvil without any occurrence of bending of the work 10 during crimping operation.

The crimping confirming device 36 confirms incorrect terminal crimping (insulative material included in wires, existence of reduced diameter area on the naked wire portion, no terminal connected to the naked wire portion, deformation of terminal or the like malfunction) by visually inspecting a silhouette of the terminal crimped to the work 10.

The work 10 adapted to move stepwise in the transverse direction in front of the group of crimping machines is caused to stop at the working position on all the crimping machines 9 and in response to a command issued from the control circuit to be described later it is subjected to crimping after a certain crimping machine 9 with a required kind of terminals held therein is selectively determined with respect to each of the A and B ends of the work 10. Thus, a terminal is crimped to the work 10 with the required crimp height being maintained. After it is visually confirmed that a terminal is correctly crimped to the work, it is discharged from the conveyor 23. A certain number of thus crimped terminals are stored in accordance with their kind and they are then transported to the next step. Incidentally, in FIG. 1 reference numeral 35 designates a control panel for the apparatus of the invention.

The apparatus of the invention constituted by the above-described sections is provided with an automatic control circuit which assures that selection of kind of cable in the cable selecting section, measurement of length of selected cable in the cable measuring and cutting section, operation of the sheath stripping section in dependence on diameter of cable and length of sheath to be stripped, selection of crimping machine, adjustment of crimp height and selection of a combination of cable and terminal in the terminal crimping section and others are automatically and continuously controlled at every time when operations are performed for a selected cable. Further, arrangement is made such that informations relative to detection and confirmation carried out by the joint detector 19, the electrical communication confirming machine 29 and the crimping confirming device 36 are immediately fed forward or backward to the associated sections located forwardly and rearwardly of the section in which detection and confirmation have been achieved whereby countermeasures against occurrence of any abnormality in each of the sections are automatically controlled. Specifically, a number of fixed data relative to cables to be worked and terminals to h=pressure connected, production schedules for each of kinds of cables and model numbers of crimped terminals and variable data such as data relative to terminals held on the crimping machines 9, data relative to cables stored in the packs 7 (diameter, color or the like of cables) and others are inputted into the above-mentioned control circuit so that selection of cable and terminal and their working conditions are determined in the form of command for each of products comprising a cable and terminals crimped thereto respectively. Accordingly, each of the sections is automatically controlled at every time when operations are performed for a combination of cable and terminals.

On the other hand, the above-mentioned detection informations, for instance, informations relative to abnormality detected by the joint detector 19 are immediately transmitted to the cable selecting section 2 and the cable measuring and cutting section 3 and thereby a cable of which abnormality is detected is cut off by the predetermined length in the cable measuring and cutting section 3 to be thrown away from the latter. Immediately after removal of the incorrect part of cable the cable selecting section 2 and the cable measuring and cutting section 3 start their operations again to produce an alternative product without interruption of production program due to detection of incorrect part of cable. If an abnormality (incorrect stripping or the like) is detected by the electrical communication confirming machine 29, abnormality information is transmitted to the terminal crimping section 5 so that no terminal is pressure connected to cable and the latter is then discharged from the apparatus as a rejected product. Thereafter, a production program is automatically inputted into for producing an alternative product to substitute for the aforesaid rejected one.

According to the present invention cables and terminals to be selected and their working conditions are automatically and continuously controlled for each of products included in a production schedule and countermeasures are automatically taken when any trouble occurs in the production steps. Accordingly, the apparatus of the invention is advantageously employable not only for producing a large number of products in a few kinds but also for producing a small number of products in various kinds accompanied by a requirement for production under such a strict working conditions that a single specification is allocated to a single kind of product.

It should be added that the above-described sections constituting the apparatus has the following characterizing features.

First, the cable storing section 1 constructed in the pack system has a very high capacity of cable storing compared with the conventional reel system and has no necessity for excessive tension force when cable is to be drawn therefrom, resulting in very few occurrence of trouble during cable drawing. Next, since the cable measuring and cutting section 3 employs a direct measuring mechanism in which a distance of movement of the measuring head 14 is measured while cable is linearly stretched by the measured distance under the effect of tension, a remarkably improved cutting accuracy is obtainable compared with the conventional indirect measuring mechanism including a plurality of feed rollers.

Further, since the sheath stripping machine is equipped with an adjusting mechanism for adjusting a length of stripping and each of the pressure connecting machines 9 is equipped with an adjusting mechanism for adjusting crimp height, it is possible to carry out crimping for all combinations of various kinds of cables and various kinds of terminals.

While the present invention has been described above with respect to a single embodiment thereof, it should of course be understood that it should not be limited only to this but various changes or modifications may be made in any acceptable manner without any departure from the spirit and scope of the invention.

What is claimed is:

1. An apparatus for automatically producing cable with terminals crimped thereto comprising a cable storing section for storing a plurality of various kinds of cables each at a position predetermined in accordance with its kind, a cable selecting section for selectively taking a certain cable from a selected one of the group of cables stored in said cable storing section, a cable measuring and cutting section for measuring a predetermined extended length of a cable selected in said cable selecting section and cutting it to a preselected measured length, a cable sheath stripping section in which insulative sheaths at the cut ends of the selected cable are stripped, a terminal crimping seciton including a plurality of terminal crimping machines and feed means for different terminals and each having a crimp height adjusting mechanism incorporated therein, and a control circuit controlling said cable selecting section, said cable measuring and cutting section, said sheath stripping section and said terminal crimping section for selecting in sequence the desired kind of cable to be processed, measuring and cutting the appropriate length of the selected cable, stripping the ends thereof, and selecting the appropriate preselected terminal for each of said ends and attaching by crimping the selected terminals to the stripped ends.

2. An apparatus as defined in claim 1, wherein the cable measuring and cutting section includes a direct measuring mechanism in which a distance of extension of a selected cable is measured while it is kept in the stretched state.

3. An apparatus as defined in claim 1, wherein the cable sheath stripping section includes a stripping length adjusting mechanism.

4. An apparatus as defined in claim 1, wherein the cable storing section comprises a plurality of hollow cylindrical packs having open upper ends and each receiving a bundle of cable in the form of a coil.

5. An apparatus as defined in claim 4, wherein the cable selecting section includes a bed having transversely spaced apart areas thereon each adapted to receive cable from a respective one of the bundles.

6. An apparatus as defined in claim 1, further including an electrical communication confirmation testing device interposed between the cable sheath stripping section and the terminal crimping section for testing to determine that the cable is properly stripped in the cable sheath stripping section, the control circuit being operative to disable the subsequent terminal crimping section operation in the event the stripping has not been properly completed.

7. An apparatus as defined in claim 6, wherein the control circuit further reprograms a new cable operation for the rejected cable so as to produce the desired number of cables of each of the respective kinds.

8. An apparatus as defined in claim 1, further including a terminal checking section positioned downstream of the terminal crimping section for testing to ensure that terminals have been properly attached to the ends of the selected cable.

9. An apparatus as defined in claim 8, wherein the control circuit further includes means for reprogramming a new selected cable in the event the terminal attachment test is not successfully passed so as to produce the desired number of cables of each type.

10. An apparatus as defined in claim 1, wherein the cables are moved along a predetermined path from the cable sheath stripping section and the terminal crimping section and the means for stripping the cable sheath in the cable stripping section and the means for attaching terminals in the terminal crimping section are all disposed at one side of said path.

11. An apparatus as defined in claim 10, further including means between the cable measuring and cutting section and the cable sheath stripping section for folding the cut cable back upon itself so that the cut severed ends are disposed at the one side of the path.

12. An apparatus as defined in claim 11, wherein the cable sheath stripping section further includes means for cutting a predetermined length from the ends of the cable so as to prevent uniform end positions thereto.

* * * * *